US009383178B2

(12) United States Patent
Powers, Jr.

(10) Patent No.: US 9,383,178 B2
(45) Date of Patent: Jul. 5, 2016

(54) HOLLOW POINT BULLET AND METHOD OF MANUFACTURING SAME

(71) Applicant: Sig Sauer, Inc., Newington, NH (US)

(72) Inventor: Daniel L. Powers, Jr., Thonotosassa, FL (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/614,678

(22) Filed: Feb. 5, 2015

(65) Prior Publication Data

US 2015/0308799 A1 Oct. 29, 2015

Related U.S. Application Data

(60) Provisional application No. 61/936,493, filed on Feb. 6, 2014.

(51) Int. Cl.
*F42B 12/34* (2006.01)
*F42B 12/78* (2006.01)

(52) U.S. Cl.
CPC ..... *F42B 12/34* (2013.01); *F42B 12/78* (2013.01)

(58) Field of Classification Search
CPC ..... F42B 12/34; F42B 12/76; F42B 12/78; F42B 12/80; F42B 12/82
USPC ..... 102/514, 515, 516, 507, 508, 509, 510
See application file for complete search history.

(56) References Cited

U.S. PATENT DOCUMENTS

| | | | | |
|---|---|---|---|---|
| 219,840 | A | 9/1879 | Winchester | |
| 376,302 | A | 1/1888 | Gregg | |
| 1,059,213 | A | 4/1913 | Ross | |
| 1,080,974 | A | 12/1913 | Johnson | |
| 1,095,501 | A | 5/1914 | Hoagland | |
| 1,135,357 | A | 4/1915 | Clyne | |
| 1,475,578 | A * | 11/1923 | Hadfield | F42B 14/02 102/526 |
| 1,556,160 | A | 10/1925 | Riggs | |
| 1,633,168 | A | 6/1927 | Dickerman | |
| 1,681,295 | A | 8/1928 | Johnson | |
| 1,715,788 | A | 6/1929 | Rousseu | |
| 1,730,871 | A | 10/1929 | Aronson | |
| 1,833,127 | A | 11/1931 | Rinkel | |
| 2,045,964 | A | 6/1936 | Rinkel | |
| 2,123,981 | A | 7/1938 | Whipple | |
| 2,327,950 | A | 8/1943 | Whipple | |
| 2,765,738 | A | 10/1956 | Frech | |
| 2,838,000 | A | 6/1958 | Schreiber | |

(Continued)

OTHER PUBLICATIONS

Design U.S. Appl. No. 29/473,820, filed Nov. 26, 2013, title "Skiving Punch".

*Primary Examiner* — Stephen M Johnson

(74) *Attorney, Agent, or Firm* — Finch & Maloney PLLC

(57) ABSTRACT

Hollow point bullets and methods of manufacturing such bullets are herein disclosed. The disclosed bullets include a monolithic core encased by a metal jacket. The jacket includes a plurality of v-shaped channels formed on the inner surface of the sidewall of the jacket. The core includes a conical recess formed therein and a cavity in communication with the conical recess. The cavity formed in the core may have a cross-section shape defined by a plurality of points spaced equidistantly about the circumference of an imaginary circle. A plurality of stress risers may be formed in the core, each stress riser extending from the cavity to a v-shaped channel in coincidence with a point of the cross-section shape of the cavity.

11 Claims, 10 Drawing Sheets

(56) References Cited

U.S. PATENT DOCUMENTS

| | | | | |
|---|---|---|---|---|
| 2,982,550 | A * | 5/1961 | Francis | F42B 6/10 102/526 |
| 3,003,420 | A | 10/1961 | Nosler | |
| 3,120,188 | A | 2/1964 | Kreuzer | |
| 3,157,137 | A | 11/1964 | Burns, Jr. | |
| 3,165,809 | A | 1/1965 | Burns et al. | |
| 3,311,962 | A | 4/1967 | Burns, Jr. | |
| 3,349,711 | A | 10/1967 | Darigo et al. | |
| 3,431,612 | A | 3/1969 | Darigo et al. | |
| 3,881,421 | A | 5/1975 | Burczynski | |
| 4,044,685 | A | 8/1977 | Avcin | |
| 4,069,586 | A | 1/1978 | Skelton | |
| 4,193,348 | A | 3/1980 | Halverson | |
| 4,245,557 | A | 1/1981 | Knappworst et al. | |
| 4,387,492 | A | 6/1983 | Inman | |
| 4,550,662 | A | 11/1985 | Burczynski | |
| 4,610,061 | A | 9/1986 | Halverson | |
| 4,655,140 | A | 4/1987 | Schirneker | |
| D294,000 | S | 2/1988 | Friedrich | |
| 4,819,563 | A | 4/1989 | Bodet | |
| 4,829,906 | A | 5/1989 | Kaswer | |
| 4,836,110 | A | 6/1989 | Burczynski | |
| 4,882,822 | A | 11/1989 | Burczynski | |
| 4,947,755 | A | 8/1990 | Burczynski | |
| 5,079,814 | A | 1/1992 | Moore et al. | |
| 5,101,732 | A | 4/1992 | Schluckebier | |
| 5,131,123 | A | 7/1992 | Brooks | |
| 5,208,424 | A * | 5/1993 | Schluckebier | F42B 12/34 102/509 |
| 5,259,320 | A | 11/1993 | Brooks | |
| 5,357,866 | A | 10/1994 | Schluckebier et al. | |
| D363,335 | S | 10/1995 | Dixon | |
| 5,528,990 | A | 6/1996 | Corzine et al. | |
| D371,302 | S | 7/1996 | Spirer | |
| D374,802 | S | 10/1996 | Spirer et al. | |
| 5,641,937 | A | 6/1997 | Carter | |
| 5,811,723 | A | 9/1998 | Stone | |
| 6,257,149 | B1 | 7/2001 | Cesaroni | |
| 6,305,292 | B1 | 10/2001 | Burczynski et al. | |
| D452,894 | S | 1/2002 | Benini | |
| D482,252 | S | 11/2003 | Hyde | |
| 6,805,057 | B2 | 10/2004 | Carr et al. | |
| D511,003 | S | 10/2005 | Sliwa, Jr. | |
| D518,178 | S | 3/2006 | Christiansen | |
| D561,543 | S | 2/2008 | Callander | |
| 7,360,491 | B2 | 4/2008 | Sanborn | |
| D603,045 | S | 10/2009 | Peterson | |
| D626,619 | S | 11/2010 | Gogol et al. | |
| D632,357 | S | 2/2011 | Dixon | |
| D654,591 | S | 2/2012 | Gunnersen | |
| D694,788 | S | 12/2013 | Carper | |
| D715,888 | S | 10/2014 | Padgett | |
| D719,590 | S | 12/2014 | Johnston | |
| D726,281 | S | 4/2015 | Powers | |
| D727,126 | S | 4/2015 | Robinson | |

* cited by examiner

HOLLOW POINT BULLET AND METHOD OF MANUFACTURING SAME

CROSS-REFERENCE TO RELATED APPLICATIONS

This application claims the benefit of U.S. Provisional Patent Application No. 61/936,493, filed on Feb. 6, 2014, which is herein incorporated by reference in its entirety.

FIELD OF THE DISCLOSURE

This disclosure relates generally to ammunition, and more particularly, to a hollow point bullet and a method of manufacturing such a bullet.

BACKGROUND

Bullets and other types of ammunition serve important functions in the fields of law enforcement, military operation, personal defense, hunting, and target shooting. Hollow point bullets are known to have superior stopping power, as they can expand in a mushroom-like manner upon impact with a target. This expansion effect can prevent a bullet from passing through the target and injuring bystanders, and also allows the bullet to more fully transfer its kinetic energy to a target.

SUMMARY

According to an example embodiment, a bullet includes a center axis, a substantially cylindrical core and a jacket surrounding the core. The substantially cylindrical core includes a nose portion having a conical recess formed therein and a cavity formed in the core. The cavity extends along the center axis in communication with the conical recess. The cavity may have a cross-section shape defined by a plurality of points spaced equidistantly around the circumference of an imaginary circle. The core also includes a plurality of stress risers. Each stress riser extends radially outward from the center axis in coincidence with a point of the cross-section shape. The jacket includes a base and a sidewall. The sidewall includes a base, a top edge, an inner surface and an outer surface. The inner surface of the sidewall includes a plurality of v-shaped channels formed therein. Each v-shaped channel is adjacent to one of the stress risers and extends longitudinally from the top edge, such that a distance from the inner surface to the outer surface increases as a function of distance from the top edge toward the base.

In some cases, the cross-section shape of the cavity comprises between three and eight points. In some cases, the cross-section shape of the cavity comprises six points. In some cases, the jacket sidewall comprises between three and eight v-shaped channels. In some such cases, the sidewall of the jacket comprises six v-shaped channels. In some cases, the base of the jacket is substantially flat. In some embodiments, the core is a monolith. In some embodiments, the jacket further includes a plurality of indentations formed in the outer surface of the sidewall about a circumference of the jacket. In some such cases, each indentation is angled with respect to the center axis such that a deeper portion of the indentation is closer to the base of the jacket and a shallower portion of the indentation is closer to the top edge of the jacket. In some cases, the jacket comprises at least one of: copper, brass, steel, aluminum and combinations thereof. In some cases, the core comprises at least one of: lead, antimony, bismuth, tin, aluminum, zinc, steel and alloys thereof. In some cases, the core includes a hardening agent within the weight percent range of 0.5-6 percent, or within the weight percent range of 1.5-3 percent. In some cases, the cavity extends to a depth inside the core, and the depth is within the range of 0.040-0.125 inches. In some cases, the cavity is between 0.030-0.070 inches in diameter as measured by the diameter of an inscribed circle between the points of the cross-section shape. In some cases, the conical recess has a 45 degree angle with respect to the center axis. In some cases, the bullet further includes a plurality of notches, and each notch is formed in the top edge of the sidewall above a v-shaped channel.

According to another example embodiment, a bullet includes a center axis, a core and a jacket surrounding the core. The jacket includes a sidewall having a base, an outer surface, an inner surface, and a plurality of indentations formed in the outer surface about a circumference of the jacket. Each indentation is angled with respect to the center axis such that a bottom portion of each indentation extends at least 50% more into the outer wall than a top portion of each indentation.

According to another example embodiment, a method of manufacturing a bullet includes the acts of inserting a monolithic core into a jacket having a base, a sidewall having an outer surface, an inner surface, a circular top edge having a first radius, and a center axis centered about the circular top edge; skiving the jacket to form a plurality of inwardly angled v-shaped channels in the inner surface, each v-shaped channel being angled with respect to the center axis such that a distance from the inner surface to the outer surface increases as a function of distance from the top edge toward the base; forming a cavity in the monolithic core, the cavity having a cross-section shape defined by a plurality of points spaced equidistantly around a circumference of an imaginary circle centered about the center axis; and forming a plurality of scores in the monolithic core, each score extending from one of the v-shaped channels toward the center axis. In some cases, the method also includes at least one of: shaping a conical recess in a top portion of the core; compressing the core to form a plurality of stress risers in the monolithic core, each stress riser extending from a v-shaped channel to a point of the cross-section shape of the cavity; and molding the top edge to have a second radius that is less than the first radius. In some embodiments, the method also includes the act of polishing the bullet with polishing media. In some cases, the cavity is maintained during the act of compressing. In some cases, the method also includes the act of knurling the outer surface of the jacket to form a plurality of indentations about a circumference of the jacket. In some such cases, each indentation is angled with respect to the center axis such that at a bottom portion of the indentation is deeper than a top portion of the indentation. In some embodiments, the cross-section shape of the cavity includes six points. In some cases, the acts of skiving the jacket and creating inwardly angled v-shaped channels occur simultaneously. In some cases, the acts of skiving the jacket, creating inwardly angled v-shaped channels and forming a plurality of scores in the monolithic core occur simultaneously. In some cases, the acts of molding the top edge and shaping a conical recess are performed and occur simultaneously. In some embodiments, the acts of molding the top edge, shaping a conical recess and compressing the core to form a plurality of stress risers are performed and occur simultaneously. In some cases, the method also includes the act of piercing the top edge at equidistant points, thereby forming notches in the top edge, and each notch is directly above a v-shaped channel.

According to another example embodiment, a skiving tool includes a base portion, a tip, a center axis and a plurality of cutting edges. The cutting edges are defined by the intersection of two surfaces. Each cutting edge extends radially from the tip. Each cutting edge is positioned equidistantly about the center axis. Each cutting edge also defines a taper angle formed between the cutting edge and the center axis and a cutting angle formed between the two surfaces defining each cutting edge. In some embodiments, the skiving tool includes between three and eight cutting edges. In some such cases, the skiving tool includes six cutting edges. In some embodiments, the taper angle of the skiving tool is within the range of 30-50 degrees. In some such embodiments, the taper angle is approximately 40 degrees. In some cases, each cutting edge is defined by two substantially planar surfaces. In some cases, the cutting edge angle is within the range of 50-70 degrees. In some such cases, the cutting edge angle is approximately 58 degrees.

The features and advantages described herein are not all-inclusive and, in particular, many additional features and advantages will be apparent to one of ordinary skill in the art in view of the drawings, specification and claims. Moreover, it should be noted that the language used in the specification has been selected principally for readability and instructional purposes and not to limit the scope of the inventive subject matter.

BRIEF DESCRIPTION OF THE DRAWINGS

The figures are not intended to be drawn to scale. In the figures, each identical or nearly identical component that is illustrated in various figures is represented by a like numeral. For purposes of clarity, not every component may be labeled in every figure.

DETAILED DESCRIPTION

Figure 1:
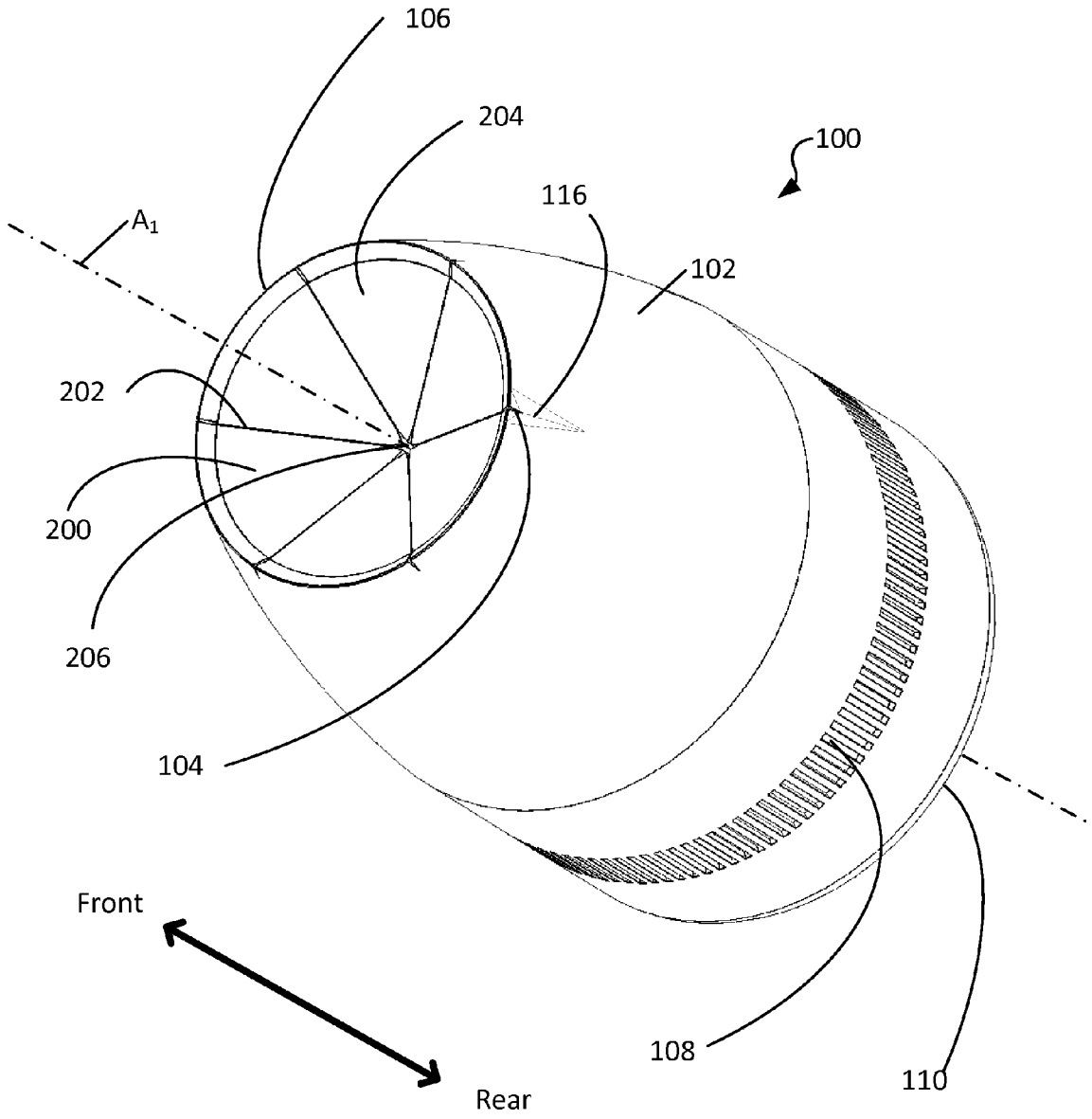
FIG. 1 is a perspective view of an example bullet, in accordance with an embodiment of the present disclosure.

Hollow point bullets and methods of manufacturing such bullets are disclosed. In some embodiments, the bullets include a monolithic core encased by a metal jacket. The jacket may include a plurality of v-shaped channels formed on at least a portion of the inner surface of the sidewall of the jacket. The core may include a conical recess formed therein and a cavity in communication with the conical recess. In some embodiments, the cavity formed in the core has a cross-section shape defined by a plurality of points spaced equidistantly about the circumference of an imaginary circle. In some embodiments, a plurality of stress risers are formed in the core. Each stress riser extends from the cavity to one of the v-shaped channels, coinciding with a point of the cross-section shape of the cavity. Numerous configurations and variations will be apparent in light of this disclosure.

General Overview

A hollow point bullet is a type of expanding bullet that generally includes a metal jacket and a malleable core. The tip of the bullet is hollowed out to allow the bullet to expand or fragment after impact with a target. Several techniques for imparting expansion capabilities to hollow point bullets have been attempted. For example, some existing bullets include jackets that have been scored or cut to encourage the jacket to unfold along the scores or cut lines. Other existing designs incorporate a core formed of separate wedge-shaped pieces, which encourage the distinct components of the core to separate upon impact. However, such designs suffer from a number of disadvantages. For example, these bullets tend to expand in an unpredictable manner. Additionally, such bullets generally expand prematurely after impact, leading to less than optimal target penetration. Accordingly, there is a need for an improved hollow point bullet that has excellent stopping power, enhanced entry capabilities, and predictable expansion and penetration patterns.

Thus, and in accordance with a set of embodiments, improved hollow point bullets and methods of manufacture are disclosed. The disclosed methods may be used to form any caliber bullet, including, but not limited to, .20, .22, .30, .35, .40, .45 and .50 caliber bullets. The disclosed bullets are suitable for use in all types of firearms, including rifles and handguns. It is to be understood that any of the bullets disclosed herein may be incorporated into any type of cartridge or shell. Therefore, some embodiments include shells and/or cartridges containing hollow point bullets, such as those described herein.

As will be appreciated in light of this disclosure, some embodiments may realize benefits or advantages as compared to existing approaches. For instance, in some embodiments, the geometry of the bullet may allow for uniform, controlled expansion in a target. Disclosed embodiments may also provide enhanced aerodynamic properties and/or increased accuracy and penetration ability.

In an embodiment, the bullet includes a jacket and a core encased in the jacket. The jacket includes a plurality of v-shaped channels on at least a portion of the inner surface of the sidewall of the jacket, each channel being radially angled with respect to the center axis of the bullet. In some embodiments, each v-shaped channel extends from the top edge of the sidewall of the jacket. In some embodiments, the sidewall of the jacket has at least one notch formed in the top edge of the jacket, adjacent to one end of a v-shaped channel. In some embodiments, the core includes a conical recess formed in the nose portion of the bullet. The conical recess may be in communication with a cavity formed in the core. The cavity may extend into the core along the center axis of the bullet. The cavity may have a cross-section shape defined by a plurality of points. In some other embodiments, the core includes a plurality of stress risers formed therein. Each stress riser may extend from a v-shaped channel through the core to coincide with a point of the cavity. In one specific example embodiment, the bullet jacket has six v-shaped channels and six notches, the core has six stress risers and the cavity has a cross-section shape having six points.

Several advantages may be realized by the presently disclosed hollow point bullet. The conical recess in communication with the cavity formed in the core may allow the bullet to penetrate deeper into a target or to a shallower depth before expanding and/or may enhance the aerodynamics of the bullet. The alignment of the stress risers and the angled v-shaped channels, the notches in the jacket, or both may facilitate expansion upon entry into a target. Similarly, the monolithic core, the radially angled v-shaped channels, or both may allow the bullet to expand in a predictable manner without fragmenting. As used herein, the term "monolith," in addition to its plain and ordinary meaning, includes a single piece of material having uniform characteristics throughout. Other suitable uses and implementations of one or more embodiments of the present disclosure will depend on a given application and will be apparent in light of this disclosure.

Example Structure and Operation: Bullet

FIG. 1 is a perspective view of an example hollow point bullet 100, according to an embodiment of the present disclosure. As shown in FIG. 1, the bullet 100 may have an overall frustoconical, or substantially ogive shape. The bullet 100 includes a jacket 102 and a core 200 encased by the jacket 102. The jacket 102 includes a plurality of notches 104 in its top edge 106, as shown in FIG. 1. Below each notch 104 is a v-shaped channel 116 formed in the inner wall of the jacket 102 that extends toward the base 110. For clarity and illustrative purposes, only one v-shaped channel 116 is depicted in FIG. 1. Each v-shaped channel 116 is angled such that a distance from the inner wall 112 of the jacket 102 to its outer wall 114 increases as a function of distance from the top edge 106 toward the base 110. Specifications of the v-shaped channels 116 will be further defined and described with respect to FIGS. 3A, 3B and FIG. 4. The jacket 102 may also include a plurality of indentations 108 impressed or embossed around a circumference of the outer surface of the jacket 102. The plurality of indentations 108 may alternatively be referred to as a "cannelure."

The core 200 has a substantially cylindrical shape and includes a conical recess 204 formed in the front, or nose portion, as shown in FIG. 1. In one specific example embodiment, the angle of the conical recess 204 is approximately 45 degrees with respect to the center axis $A_1$ of the bullet 100; however, the angle of the conical recess 204 may be any angle within the range of 40-50 degrees. The core 200 also includes a cavity 206, which is in communication with the conical recess 204. The cavity 206 may extend into the core 200 along the center axis $A_1$ of the bullet 100.

Figure 2A:
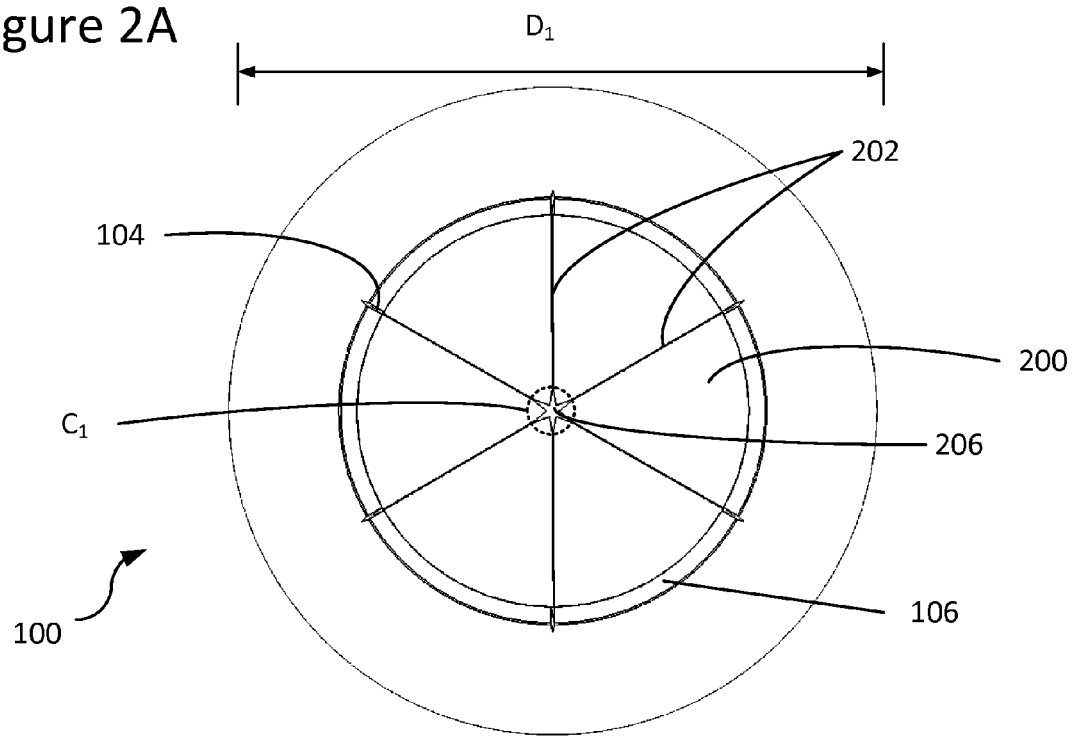
FIG. 2A is a top view of the example bullet of FIG. 1, in accordance with an embodiment of the present disclosure.
Figure 2B:
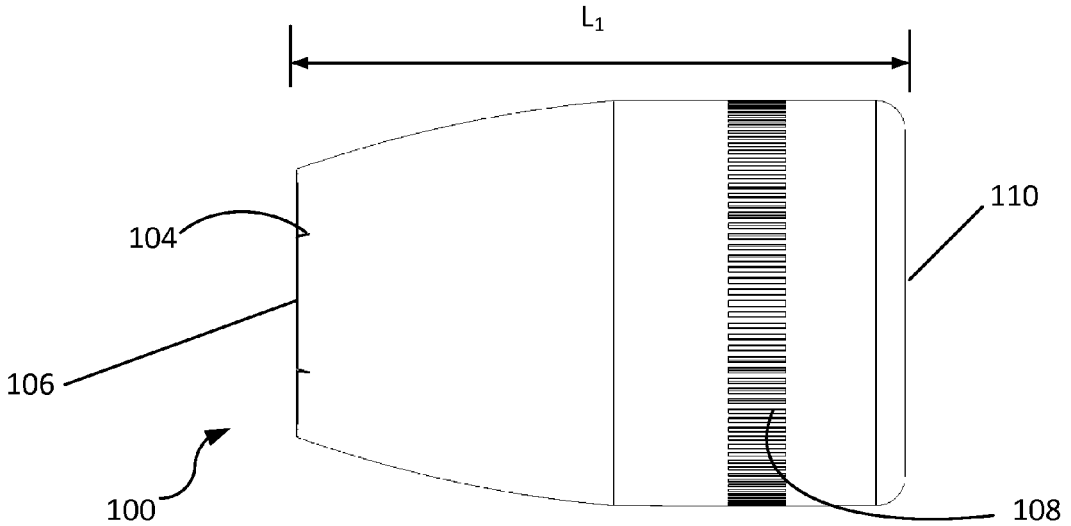
FIG. 2B is a side view of the example bullet of FIG. 1, in accordance with an embodiment of the present disclosure.
Figure 2C:
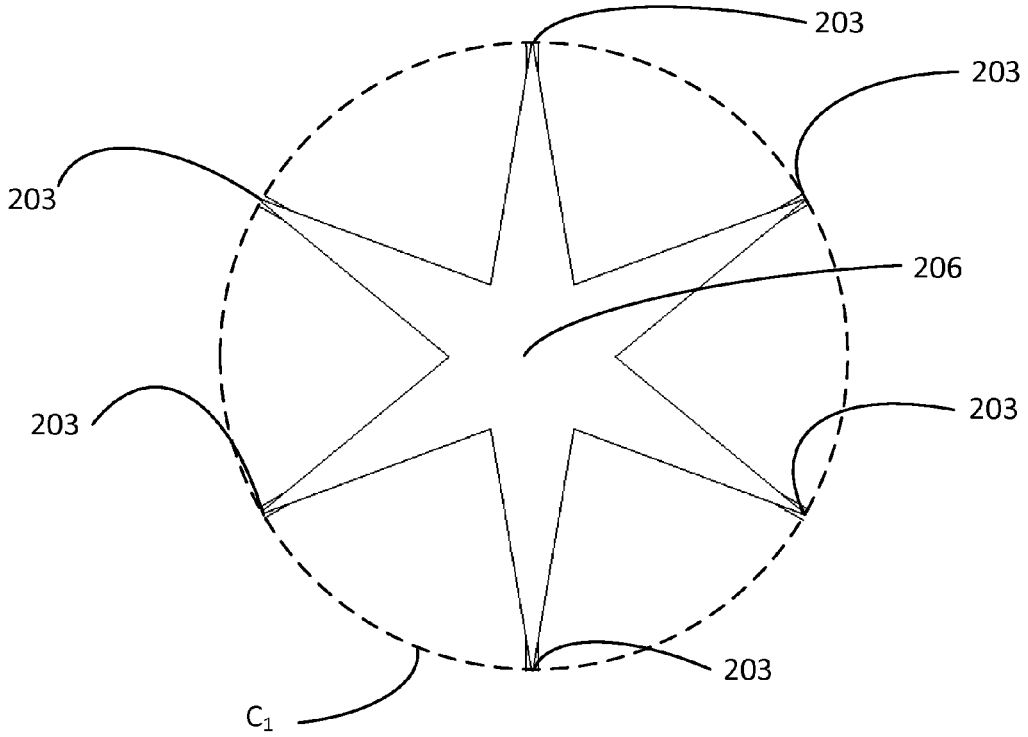
FIG. 2C is a close-up view of FIG. 2A.

FIG. 2A is a top view of an embodiment of the example bullet 100 of FIG. 1 and FIG. 2B is a side view of the embodiment of the bullet 100 shown in FIG. 2A. FIG. 2C is a close-up view of the embodiment of the bullet 100 shown in FIG. 2A. FIG. 2A illustrates an imaginary circle $C_1$ positioned about the bullet center axis $A_1$ (not shown) of the bullet 100. The cross-section shape of the cavity 206 is defined by points spaced equidistantly about the imaginary circle $C_1$. As shown in FIG. 2C, the cavity 206 has a cross-section shape having six points 203, the connecting boundary of which may form a generally sprocket-like shape. However, in other embodiments, the cavity 206 has a cross-section shape defined by any number of points 203 within the range of three to eight. The cavity 206 has a diameter that can be defined by the diameter of circle $C_1$. In some embodiments, the diameter of the cavity 206 is between approximately 0.030-0.070 inches. The core 200 also includes a plurality of stress risers 202, each of which extends from a v-shaped channel 116 (not shown) in the jacket to the cavity 206 in coincidence with a point of the cross-section shape of the cavity 206. As can be seen from FIGS. 2A and 2B, the bullet 100 has a diameter $D_1$ and length $L_1$.

Figure 3A:
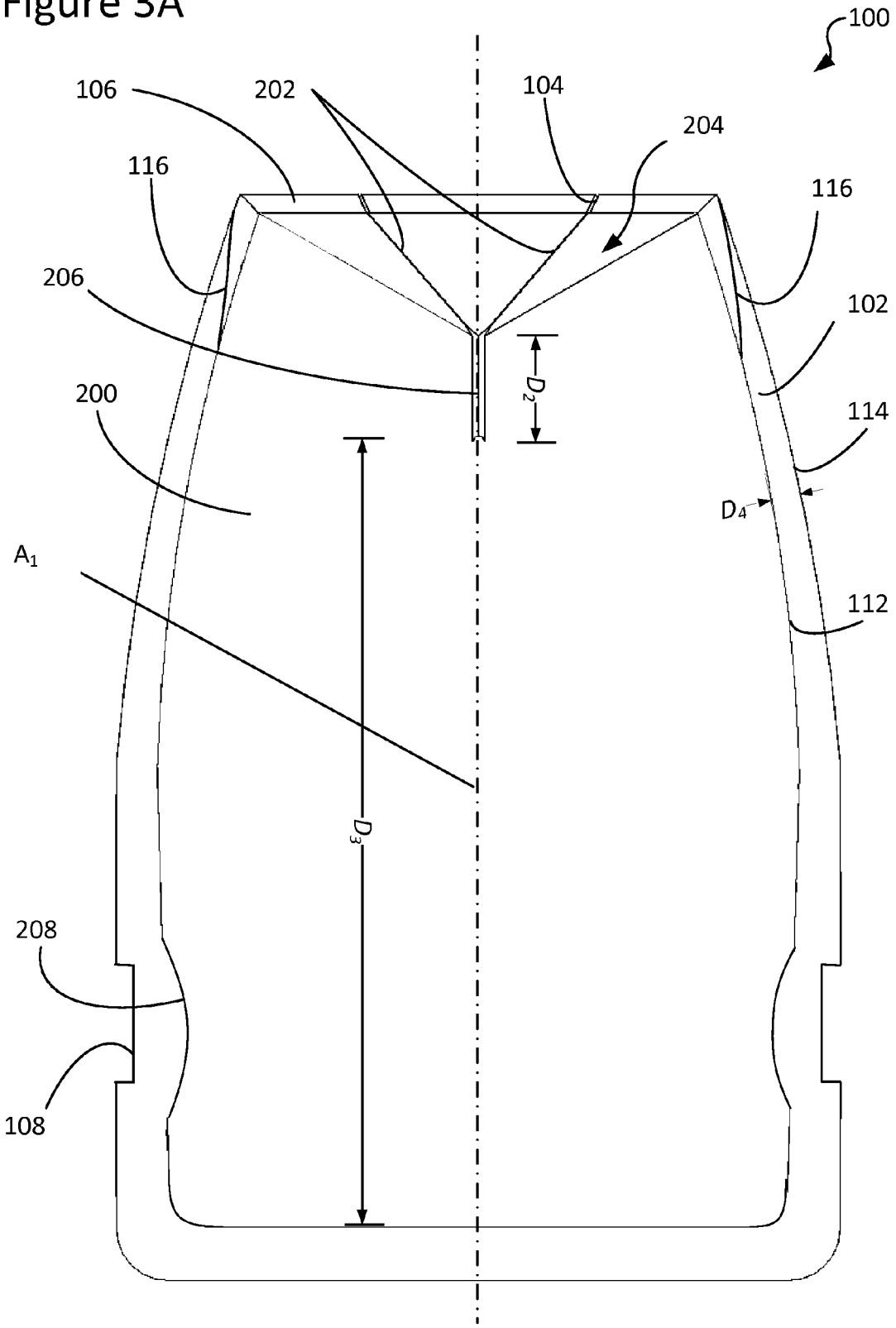
FIGS. 3A and 3B are cross-sectional side views of example bullets, in accordance with embodiments of the present disclosure.
Figure 3B:
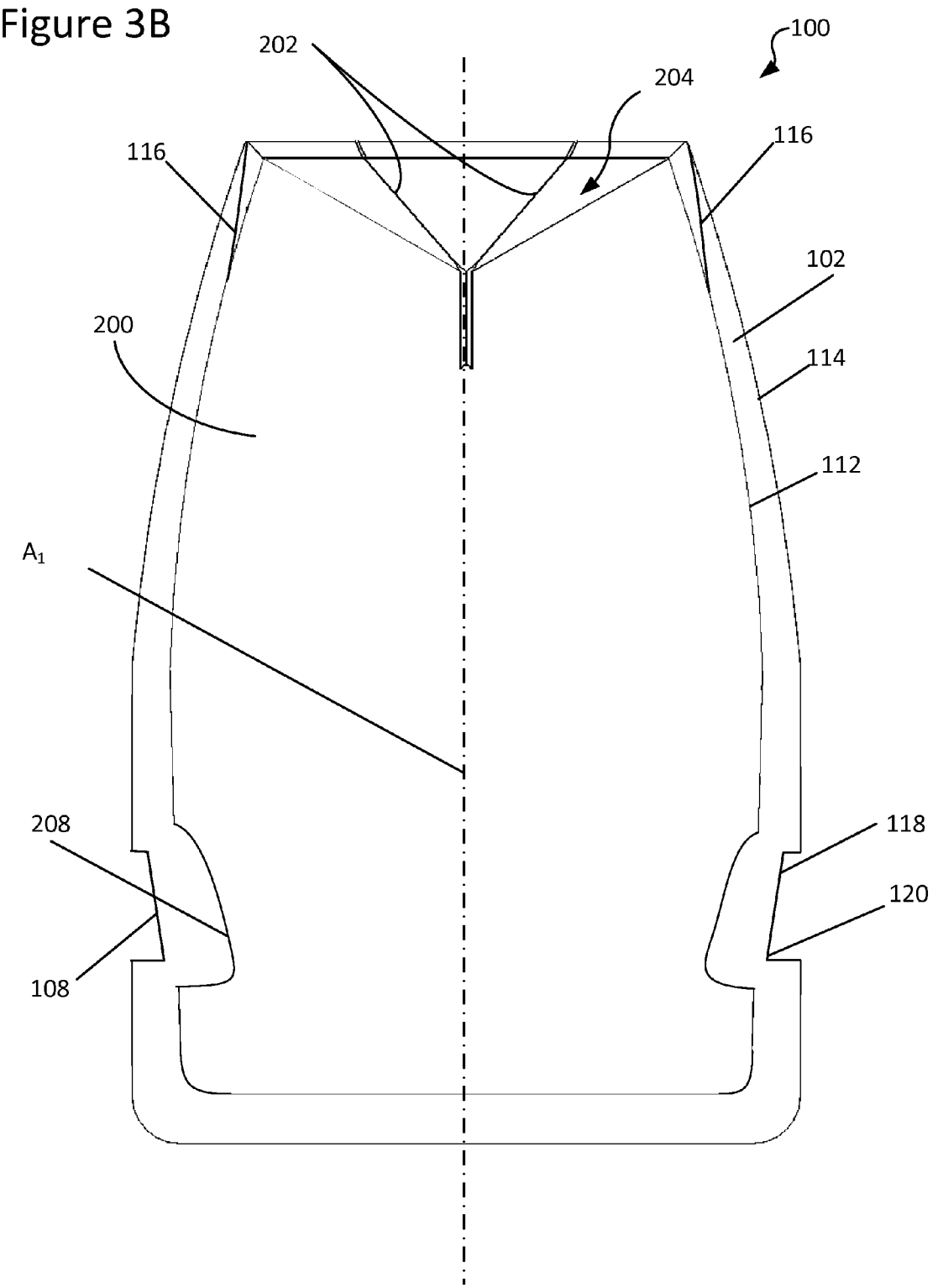

FIGS. 3A and 3B are lengthwise cross-section views of the example bullet 100 of FIG. 1. FIG. 3B is substantially the same as FIG. 3A except that the indentations 108 are angled differently in FIG. 3A as compared to FIG. 3B and, for illustrative purposes, some elements are not depicted in FIG. 3B. The core 200 is monolithic and includes a conical recess 204 formed at the nose portion of the core 200. The cavity 206 may extend a distance $D_2$ into the core 200 along the center axis $A_1$ of the bullet 100. Distance $D_3$ defines a distance of the core that does not include the cavity 206. In some embodiments, stress risers 202 extend into the core 200 a distance that is approximately equal to distance $D_2$. In some embodiments, $D_2$ is within the range of approximately 0.040-0.125 inches. The diameter of the cavity 206 may be constant or may be variable along the distance $D_2$.

The sidewall 102 of the jacket 102 includes v-shaped channels 116. FIGS. 3A and 3B depict the bullet 100 in cross-section along two of the v-shaped channels 116. The deepest point of each v-shaped channel 116 is angled with respect to the center axis $A_1$ of the bullet 100. This angle is referred to as $\theta_2$ and is defined with respect to an upright sidewall, and is more fully described in relation to FIG. 7. The distance between the inner surface 112 of the sidewall and the outer surface 114 of the sidewall, herein referred to as $D_4$, may increase as a function of distance from the top edge 106 of the jacket 102 to the base 110.

In some embodiments, the bullet 100 may be embossed, crimped, or knurled to form a plurality of indentations 108 about a circumference of the outer wall 114 of the jacket 102 as can be seen in FIGS. 3A and 3B. FIG. 3B depicts an embodiment wherein each indentation 108 is impressed into the outer wall 114 more deeply at a bottom portion 120 of each indentation 108 than at a top portion 118 of each indentation 108. FIG. 3A depicts an embodiment where the plurality of indentations 108 are impressed into the outer wall 114 equally at the top of each indentation as at the bottom of each indentation. In some embodiments, each indentation 108 extends approximately 0.010 inches into the outer surface 114 of the jacket 102. In other embodiments, each indentation 108 extends within the range of approximately 0.008-0.012 inches into the outer surface 114 of the jacket 102.

In an embodiment, such as shown in FIG. 3B, each indentation 108 extends a distance at the top portion within the range of approximately 0.005-0.008 inches and at the bottom portion within the range of approximately 0.008-0.012 inches. Each indentation 108 may be angled with respect to the center axis $A_1$ of the bullet, as shown in FIG. 3B. For example, each indentation may form an angle with the center axis $A_1$ that is within the range of between 2-5 degrees, or within the range of 5-15 degrees. In some embodiments, each indentation 108 extends greater than 50% at the bottom portion 120 of the indentation as compared to the top portion 118 of the indentation. The plurality of indentations 108 may form a core indent 208, as shown in FIGS. 3A and 3B. The indentations 108 may help the jacket 102 remain secured to the core 200 during travel and initial impact of the bullet, although it will be appreciated that in some other embodiments, the indentations 108 may be eliminated.

Figure 4:
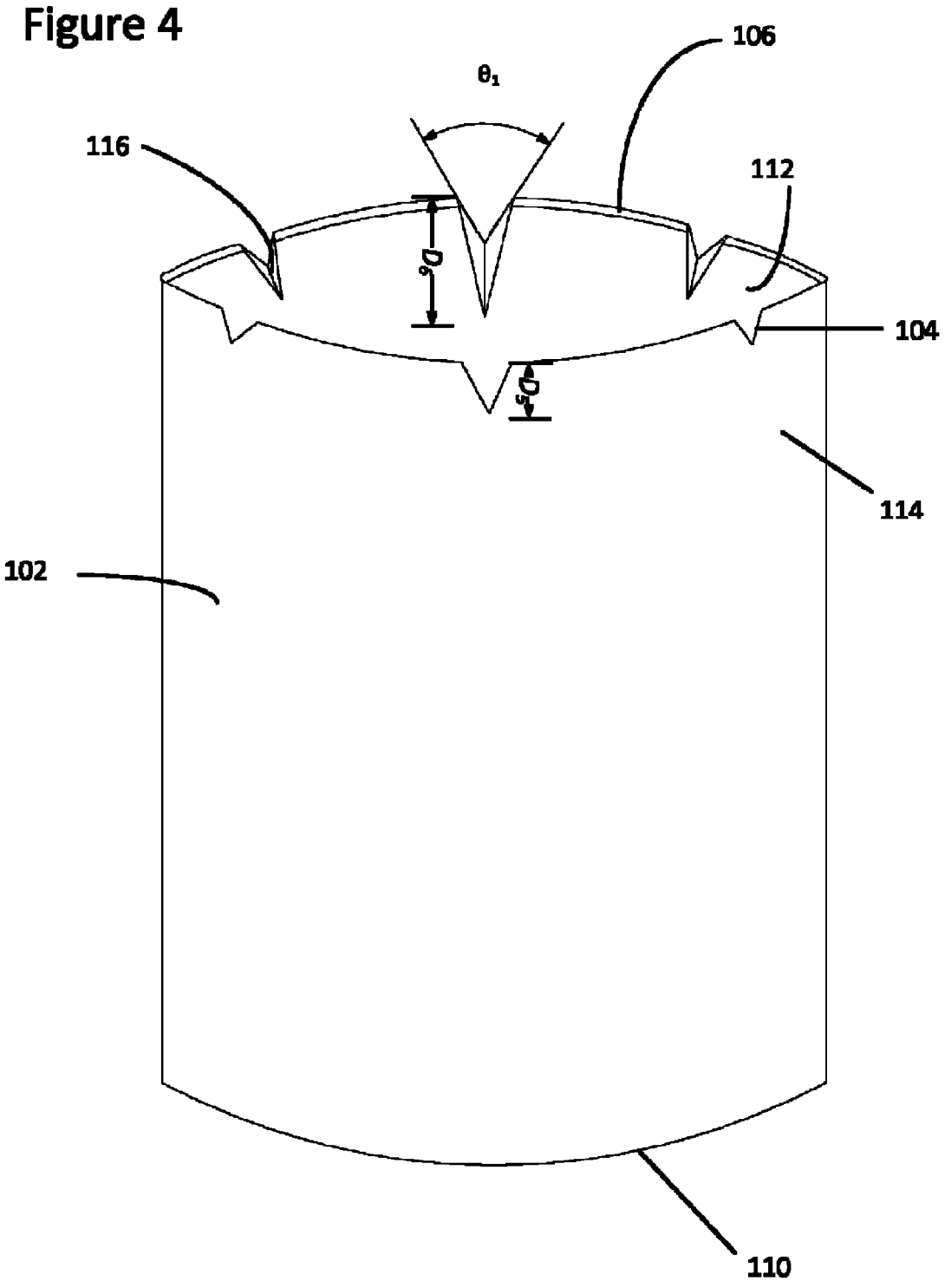
FIG. 4 is a perspective side view of an example bullet jacket shown without a core, in accordance with an embodiment of the present disclosure.

FIG. 4 is a front perspective view of the jacket 102, shown without the core 200. As can be seen from FIG. 4, v-shaped channels 116 can be formed in the inner surface 112 of the sidewall along the top edge 106. As shown, a notch 104 may be formed above each v-shaped channel 116. In some embodiments, notch 104 may be v-shaped. However, in some embodiments, the jacket 102 does not include any notches 104. In embodiments that include notches 104, each notch 104 may extend a distance $D_5$ as measured from the top edge 106 of the jacket 102. In some embodiments, $D_5$ may be within the range of approximately 0.010-0.050 inches. Each v-shaped channel may extend a distance $D_6$ from the top edge 106 of the jacket 102. In some embodiments, $D_6$ may be within the range of approximately 0.020-0.100 inches.

Figure 7:
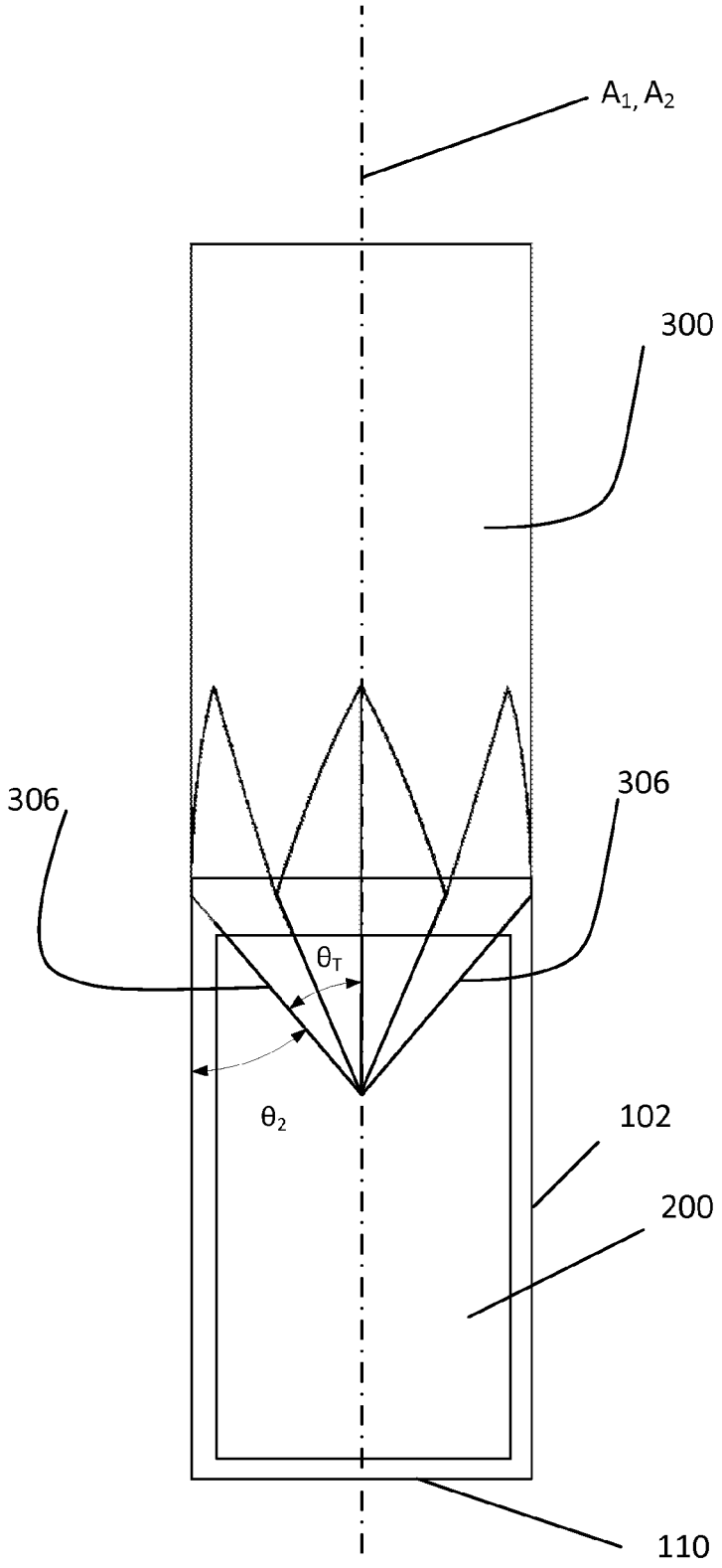
FIG. 7 is a side partial cut-away view of an example skiving tool in communication with an example bullet jacket and core, in accordance with an embodiment of the present disclosure.

Each v-shaped channel 116 may be defined by the angle of the v, $\theta_1$, as well as the angle at which the channel is positioned with respect to the outer surface 114 of the jacket 102, denoted as $\theta_2$ (not shown), and more fully described with respect to FIG. 7. In some embodiments, $\theta_1$ is approximately 58 degrees. In other embodiments, however, $\theta_1$ may be any angle within the range of approximately 50-70 degrees. In some embodiments, $\theta_2$ is approximately 40 degrees. In other embodiments, however, $\theta_2$ may be any angle within the range of approximately 30-50 degrees.

Various materials may be used to manufacture the disclosed bullet 100. For example, in some embodiments, the jacket 102 is made of copper, brass, steel, aluminum, or any combination of these alloys or other suitable alloy. In some embodiments, the core 200 is made of lead, bismuth, tin, aluminum, zinc, steel, or any combination of these alloys or other suitable alloy. In some embodiments, the core also includes a hardening agent, such as antimony, within the range of between approximately 0.5-6 percent by weight, or within the range of approximately 1.5-3 percent by weight.

In some embodiments, the bullet includes a jacket and a core as described herein. Specifically, in some embodiments, the bullet includes a jacket having a plurality of v-shaped channels, each channel being radially angled with respect to the center axis of the bullet, a core including a plurality of stress risers, a conical recess formed therein, and a cavity in communication with the conical recess. In some embodiments, the cavity is defined by a plurality of points spaced equidistantly around an imaginary circle positioned around the center axis of the bullet, and each stress riser of the core extends from a v-shaped channel to a point of the shape of the cavity. In some further embodiments, the bullet includes a cannelure, formed about a circumference of the outer surface of the jacket. In some such embodiments, the cannelure is angled radially with respect to the center axis of the bullet such that each indentation of the cannelure extends a greater distance into the outer surface of the sidewall at a bottom portion of the indentation as compared to at a top portion of the indentation. In some example embodiments, the nose portion of the core is substantially flush with the top edge of the jacket. In additional embodiments, the jacket comprises a plurality of notches in the top edge of the sidewall. In some such embodiments, each notch is positioned above a v-shaped channel.

Example Structure and Operation: Skiving Tool

Figure 5A:
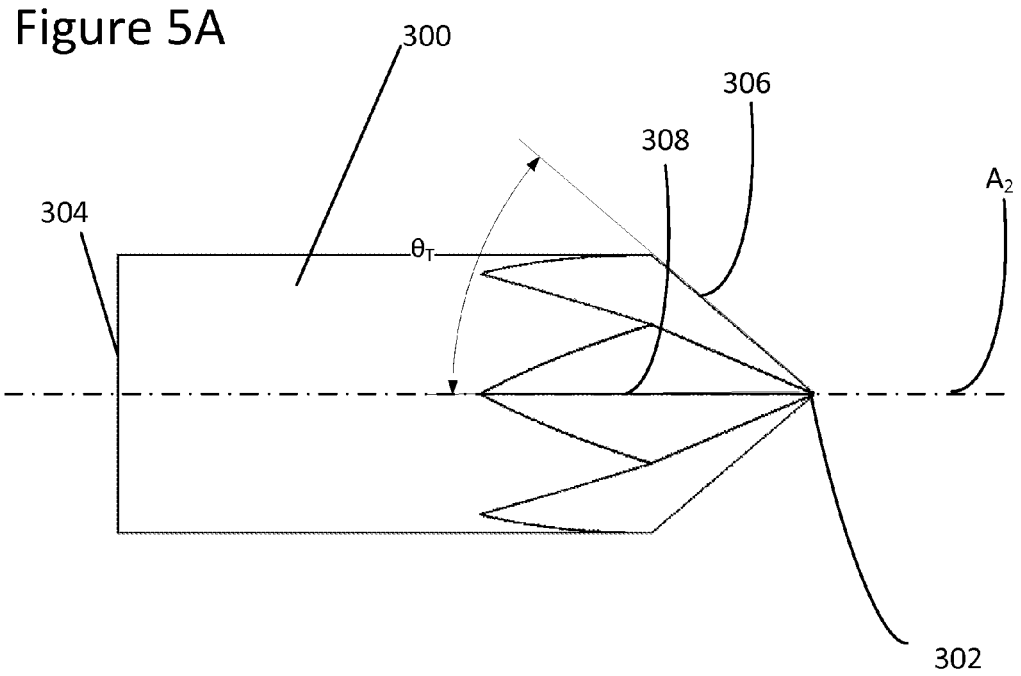
FIG. 5A is a perspective side view of an example skiving tool, in accordance with an embodiment of the present disclosure.
Figure 5B:
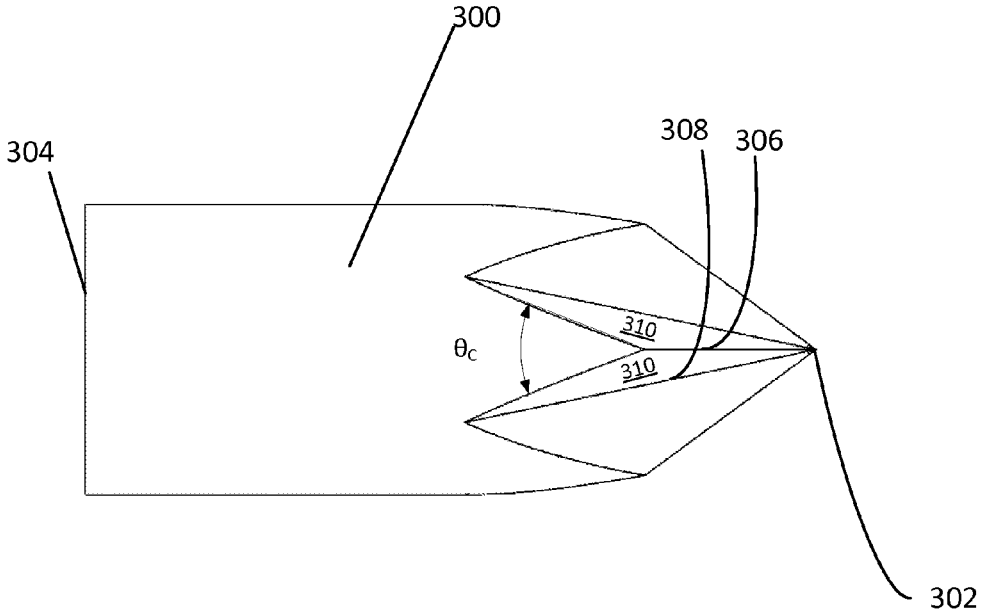
FIG. 5B is another perspective side view of the example skiving tool of FIG. 5A, in accordance with an embodiment of the present disclosure.

FIGS. 5A and 5B are side views of an example skiving tool 300, alternatively referred to as a skiving punch. The skiving tool 300 can be used to form a hollow point bullet, including bullets as variously described herein. As shown in FIGS. 5A and 5B, the skiving tool 300 has a tip 302 and a base portion 304. FIG. 5B shows the example skiving tool 300 of FIG. 5A rotated 30 degrees. As shown, the skiving tool 300 includes a plurality of cutting edges 306, each cutting edge 306 being defined by the intersection of two surfaces meeting at a cutting angle $\theta_C$. In some embodiments, $\theta_C$ is approximately 58 degrees. In other embodiments, however, $\theta_C$ is within the range of approximately 50-70 degrees. As shown, each cutting edge 306 may be separated by a valley 308. As shown in FIGS. 5A and 5B, the skiving tool 300 includes six cutting edges 306. However, in other embodiments, the skiving tool 300 may include a different number of cutting edges (e.g., any number from three to eight). As shown in FIG. 5B, two substantially planar surfaces 310 define each cutting edge 306. In other embodiments, however, the surfaces 310 of the skiving tool 300 are curved or otherwise non-planar. Each cutting edge 306 is defined by a taper angle $\theta_T$ formed between the cutting edge 306 the center axis $A_2$ of the skiving tool 300. In some embodiments, the taper angle $\theta_T$ is approximately 40 degrees. In other embodiments, however, the taper angle $\theta_T$ is any angle within the range of approximately 30-50 degrees.

Figure 6A:
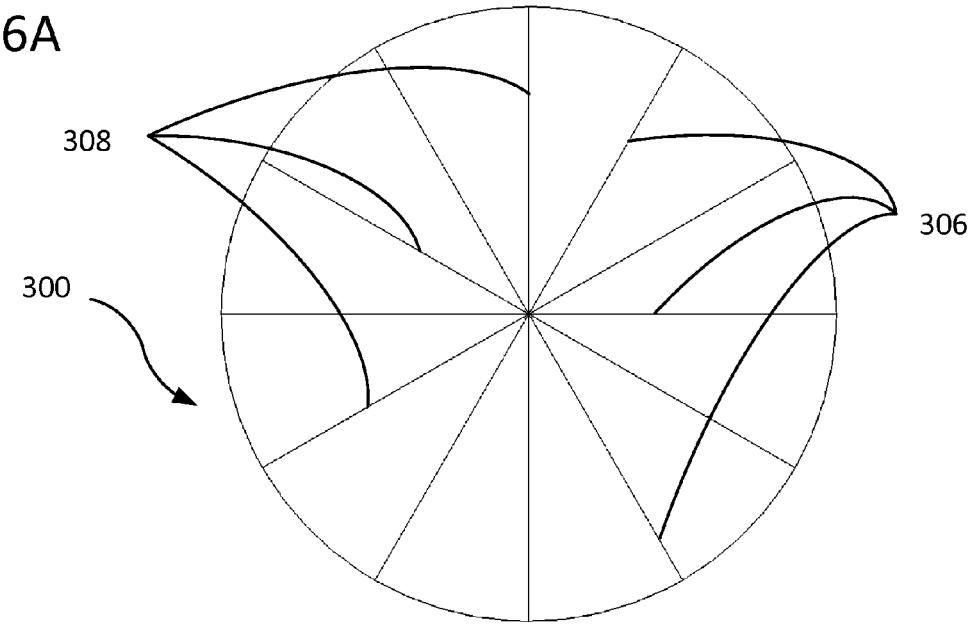
FIG. 6A is a top view of an example skiving tool, in accordance with an embodiment of the present disclosure.
Figure 6B:
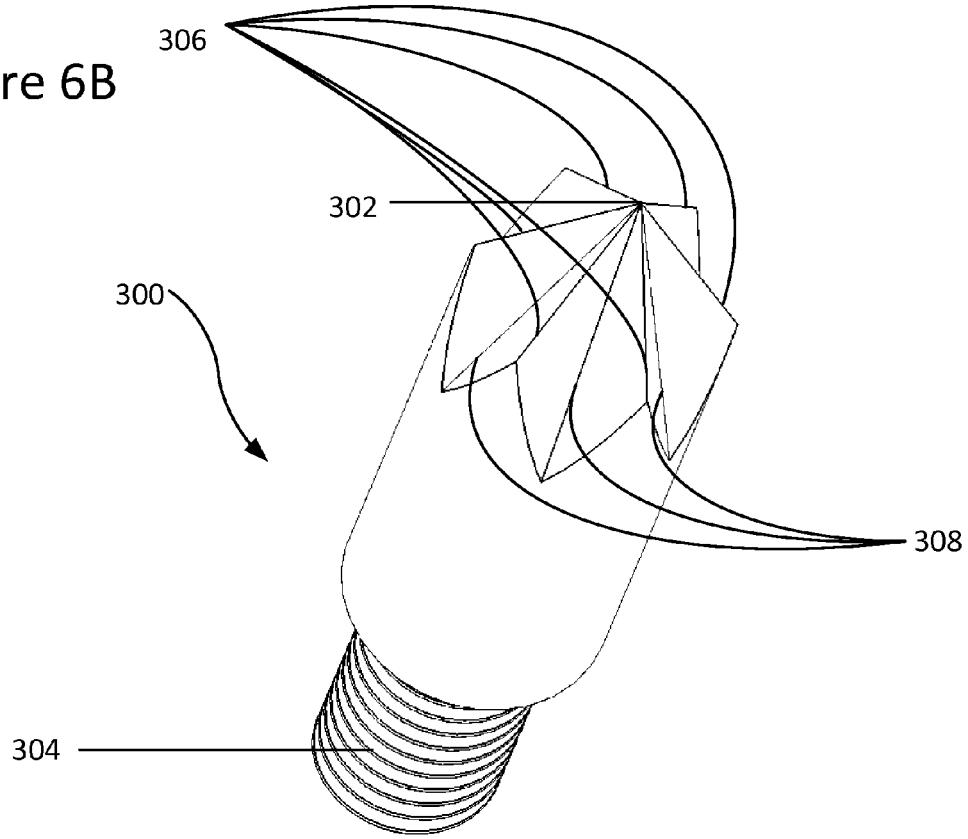
FIG. 6B is a perspective side view of the example skiving tool shown in FIG. 6A, in accordance with an embodiment of the present disclosure.

FIG. 6A is a top view of an example skiving tool 300, illustrating relative positions of the cutting edges 306 and valleys 308 in an embodiment wherein the skiving tool 300 includes six cutting edges and six valleys. As can be seen from the Figure, the cutting edges 306 are spaced equidistantly around the center axis $A_2$ (not shown) of the skiving tool 300. FIG. 6B is a perspective view of the example skiving tool 300 of FIG. 6A, also showing the cutting edges 306 and the valleys 308.

FIG. 7 shows a skiving tool 300 in communication with a jacket 102 and a core 200. As can be seen from the figure, the center axis $A_1$ of the bullet 100 may be aligned with the center axis $A_2$ of the skiving tool 300 and the skiving tool 300 may be inserted into the jacketed core. The skiving tool need not rotate as it enters or exits the jacketed core. The angle of the v-shaped channel is shown in FIG. 7 as $\theta_2$. In some embodiments, $\theta_2$ may be approximately equal to $\theta_T$ and/or $\theta_1$ may be approximately equal to $\theta_C$.

Example Methods of Manufacture

The example bullet 100 may be manufactured according to any of the example methods disclosed herein. An example method of manufacture is detailed in FIG. 8. In that example, a monolithic core may be inserted into a jacket. The jacketed core may be alternatively referred to as a 'preform' throughout this disclosure. The jacket may be any type of jacket, including a boat-tail jacket or a jacket having a substantially flat base. The jacket includes a base, a sidewall comprising an inner surface, an outer surface, and a top edge defining a first radius. In some embodiments, the core may be compressed within the jacket to yield a seated preform.

Figure 8:
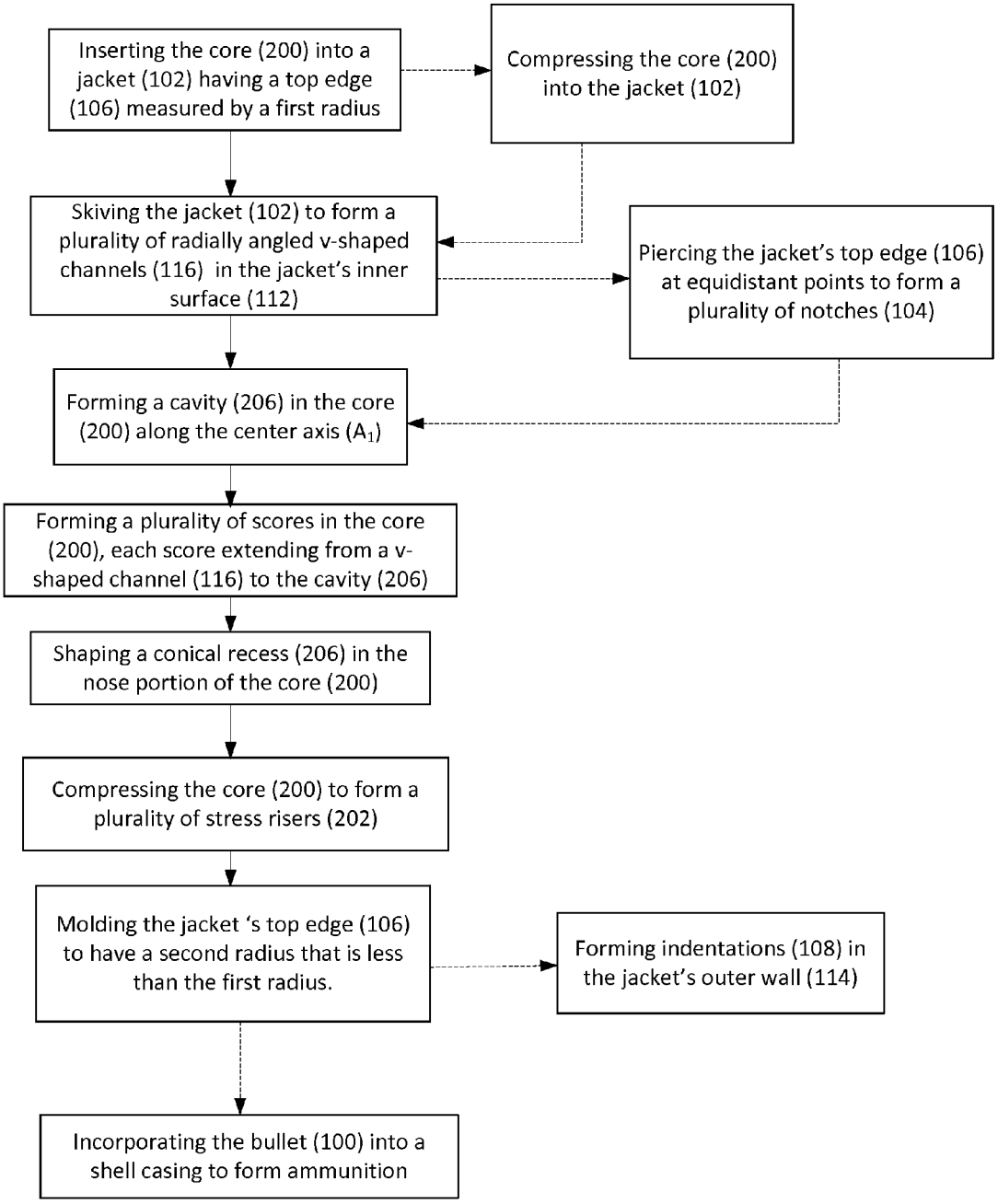
FIG. 8 is a flowchart showing an example method of manufacturing a bullet in accordance with an embodiment of the present disclosure.

According to the Example method illustrated in FIG. 8, the jacket is skived to form a plurality of v-shaped channels in the inner surface of the jacket sidewall. Each v-shaped channel may extend from the top edge of the sidewall along the inner surface of the sidewall. Each v-shaped channel may be angled with respect to the center axis of the jacket such that along each v-shaped channel a distance between the inner surface and the outer surface increases as a function of the distance from the top edge of the jacket to the base of the jacket. In some embodiments, the jacket may be skived to form between three and eight v-shaped channels. For example, in some embodiments, the jacket is skived to form six v-shaped channels.

In an embodiment, the act of skiving can be performed on the seated preform. The skiving may be performed, for example, using a skiving tool in accordance with an embodiment of the present disclosure. FIG. 7 shows a preform including a jacket 102 and seated core 200 skived using an example skiving tool 300 according to an embodiment disclosed herein.

In one specific example, the skiving tool 300 may be introduced into the core 200 to form scores. In this example, the skiving tool approaches the preform without rotational motion, and retreats from the skived preform without rotational motion. Each score may be formed by a cutting edge 306 of the skiving tool 300 as the skiving tool presses upon the core 200. The cutting edges 306 may also form v-shaped channels in the inner surface of the jacket 102 where the cutting edges contact the jacket. In this manner, the scores in the core 200 can be precisely aligned with the v-shaped channels in the jacket 102. The taper angle of the skiving tool allows the v-shaped channels to be radially angled with respect to the center axis of the jacket. Furthermore, the skiving tool 300 may be further introduced into the jacket 102 such that notches are formed in the top edge of the jacket by the cutting edges 306.

In one specific embodiment, a skiving tool having six cutting edges can be introduced into the preform. The center axis of the jacket and the center axis of the skiving tool may be aligned as the skiving tool is introduced into the preform. Six scores are formed in the core as the skiving tool is introduced into the core. The skiving tool may be further urged into the jacket to form v-shaped channels in the inner surface of the jacket. The skiving tool may be further introduced into the top edge of the jacket until notches are formed in the top edge of the jacket. The act of skiving the preform with a skiving tool may form a cavity in the core. For example, in embodiments where a skiving tool having six cutting edges is used, a cavity having six points may be formed in the core.

Another act of forming a bullet in accordance with the present disclosure is forming a cavity in the monolithic core. The cavity may extend from the nose portion of the core, in communication with the conical recess formed in the core. In some embodiments, the cavity only extends a partial distance into the core. The cavity may be formed along the center axis of the bullet and may have a cross-section shape. In some embodiments, the cross-section shape of the cavity can be defined by a plurality of points spaced equidistantly around an imaginary circle centered along the center axis of the bullet. In some embodiments, the cross-section shape includes between three and eight points. In some embodiments, the cross-section shape has the same number of points as the number of v-shaped channels. In some embodiments, this number is six. The act of forming a cavity in the monolithic core may be accomplished while the core is inside the jacket. In some embodiments, a skiving tool as disclosed herein may be used to form the cavity in the core.

In some embodiments, the cavity formed in the core by the skiving tool may be referred to as a "precursor cavity." In some embodiments, the sides of the precursor cavity may be angled with respect to the center axis of the preform. After the preform is swaged, and/or shaped with a hollow point profile die, the sides of the precursor cavity may be reshaped to be substantially parallel with the center axis of the bullet.

Exemplary methods of forming a bullet in accordance with the present disclosure also include the act of forming a plurality of scores in the monolithic core, each score extending from a v-shaped channel to the cavity. In some embodiments, the number of scores is any number within the range of three to eight. In some embodiments, the number of scores is the same as the number of v-shaped channels. In some embodiments, the plurality of scores may be formed by a skiving tool in accordance with the exemplary skiving tools disclosed herein. In some embodiments, the act of skiving the jacket, forming a plurality of scores, and/or the act of forming a cavity in the core occur simultaneously.

Another act that may be performed to create a bullet in accordance with an embodiment of the present disclosure is shaping a conical recess in a top portion of the core. This may occur, for example, by forcing a hollow-point profile die into the nose portion of the core or by forcing the core into a hollow point profile die. In some embodiments, the hollow point profile die contains a hollow-point punch. In some embodiments, shaping a conical recess occurs subsequent to the acts of skiving the jacket, forming a cavity in the core, and forming a plurality of scores in the core. In some embodiments, the act of shaping a conical recess in the core occurs through a swaging process, in which a jacketed core or a skived preform is forced into a hollow point profile die. In some embodiments, the act of shaping a conical recess includes a further act of maintaining the cavity in the core. For example, a hollow point profile die with a protrusion, such as a hollow point punch, may be used to ensure that the cavity is maintained during the manufacture of the bullet. In some embodiments, the hollow point punch resides in the extreme nose portion of the hollow point profile die in coaxial alignment with the hollow point profile die. The hollow point punch may move independently from the hollow point profile die in both an upward and a downward direction. In use, the hollow point punch may form the conical recess and may serve to eject the finished bullet from the hollow point profile die.

The core may be compressed to form a plurality of stress risers. In some embodiments, each stress riser may extend from a v-shaped channel to a point in the cross-section shape of the cavity. For example, stress risers may be formed along the scores that were impressed into the core. In some embodiments, the acts of compressing the core to form a plurality of stress risers and the act of shaping a conical recess may occur simultaneously. For example, a skived preform may be forced into a hollow point profile die and the skived preform may be compressed such that the jacket and the core adopt a substantially ogive or frustoconical shape. The die may also include a tip located at the top of the conical recess mold to ensure that the cavity is maintained during the swaging or compression process. In some embodiments, the tip is defined by a hollow point punch and/or a hollow point profile die, as previously described.

The example method also includes the act of molding the top edge of the jacket such that the radius of the top edge has a second radius that is less than the first radius. In some embodiments, this act occurs during the process of swaging, wherein the skived preform is forced into a hollow point profile die. This act may reduce the radius of the top edge of the jacket, may lessen any notches that may have been formed in the top edge of the jacket, may form stress risers in the core, may form a conical recess in the nose portion of the core, and/or may maintain the cavity formed in the core. In some embodiments, the following acts occur simultaneously: the skived preform is swaged, stress risers are formed in the core along each score, the radius of the top edge of the jacket is decreased and the conical recess is formed in the core.

The method may also include the act of forming a plurality of indentations about a circumference of the jacket, for example, by knurling. The plurality of indentations may alternatively be referred to as a cannelure. In some embodiments, the indentations are formed in the outer surface of the jacket after the acts of skiving and swaging have occurred.

In some embodiments, the skiving tool has a diameter greater than or equal to the diameter of the jacket. In some embodiments, the same skiving tool can be used to manufacture bullets of different caliber. For example, a skiving tool having a diameter of 0.353-0.355 may be used to manufacture bullets including calibers of 9 mm Luger, 380 Auto, 357 SIG and 38 Super Automatic.

In some embodiments, a bullet made in accordance with the present disclosure may be incorporated into a shell casing, or cartridge, to form ammunition. For example, a bullet may be inserted into a shell and equipped with primer and propellant.

As will be appreciated in light of this disclosure, the bullet 100 may include additional, fewer, and/or different elements or components from those here described. Moreover, present disclosure is not intended to be limited to any particular configurations or arrangements of elements such as those variously described herein, but can be used with numerous configurations in numerous applications. Further, while in some embodiments, the bullet 100 can be configured as shown and described with respect to the various figures, the claimed invention is not so limited. Other suitable geometries, arrangements, and configurations for various elements and components of the bullet 100 will depend on a given application and will be apparent in light of this disclosure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A bullet comprising:

a center axis;

a substantially cylindrical core comprising:

a nose portion having a conical recess formed therein; the core having a cavity formed therein, the cavity extending along the center axis and in communication with the conical recess, the cavity having a cross-section shape defined by a plurality of points spaced equidistantly around a circumference of an imaginary circle; and a plurality of stress risers formed in the core, each stress riser extending radially outward from the center axis in coincidence with a point of the cross-section shape; and a jacket surrounding the core, the jacket comprising:

a base;

a sidewall comprising a top edge, an inner surface and an outer surface, the inner surface of the sidewall comprising a plurality of v-shaped channels formed therein, each v-shaped channel being adjacent to one of the stress risers and extending longitudinally from the top edge such that a distance from the inner surface of the sidewall to the outer surface of the sidewall increases as a function of distance from the top edge toward the base.

2. The bullet of claim 1, wherein the cross-section shape comprises between 3 and 8 points.

3. The bullet of claim 1, wherein the sidewall comprises between 3 and 8 v-shaped channels.

4. The bullet of claim 1, wherein the core is a monolith.

5. The bullet of claim 1, further comprising a plurality of indentations formed in the outer surface of the sidewall about a circumference of the jacket.

6. The bullet of claim 5, wherein each indentation is angled with respect to the center axis such that a deeper portion of the indentation is closer to the base of the jacket and a shallower portion of the indentation is closer to the top edge of the jacket.

7. The bullet of claim 1, wherein the conical recess has a 45 degree angle with respect to the center axis.

8. A bullet comprising:

a center axis;

a core; and a jacket surrounding the core, the jacket comprising a base and a sidewall having a top edge, an outer surface, an inner surface, and a plurality of indentations formed in the outer surface about a circumference of the jacket, each indentation being angled with respect to the center axis such that a bottom portion of each indentation extends at least 50% more into the outer wall than a top portion of each indentation, wherein the inner surface of the sidewall comprises a plurality of v-shaped channels formed therein, each v-shaped channel extending longitudinally from the top edge such that a distance from the inner surface of the sidewall to the outer surface of the sidewall increases as a function of distance from the top edge toward the base.

9. The bullet of claim 8, further comprising a plurality of stress risers formed in the core, each stress riser extending from the center axis to the inner surface of the jacket sidewall.

10. The bullet of claim 8, wherein the core comprises a nose portion having a conical recess formed therein.

11. The bullet of claim 8, further comprising a cavity extending at least partially into the core along the center axis.

* * * * *